United States Patent [19]

Monaco, Jr.

[11] 4,448,560

[45] May 15, 1984

[54] ROSIN BAG AND TOWEL ATTACHED TOGETHER

[76] Inventor: Donald R. Monaco, Jr., 316 Stump Rd., North Wales, Pa. 19454

[21] Appl. No.: 457,253

[22] Filed: Jan. 11, 1983

[51] Int. Cl.[3] ..... A44B 13/00

[52] U.S. Cl. ..... 401/200; 401/4; 401/195; 428/100; 206/205; 206/210

[58] Field of Search ..... 428/100; 132/79 D, 82 R; 401/200, 4, 195; 206/205, 210

[56] References Cited

U.S. PATENT DOCUMENTS 4,165,555 8/1979 Boxer et al. ..... 428/100

FOREIGN PATENT DOCUMENTS 378592 8/1932 United Kingdom .

*Primary Examiner*—George F. Lesmes
*Assistant Examiner*—P. R. Schwartz

[57] ABSTRACT

This invention is a terry cloth towel and a bag containing powdered rosin; the towel and bag being detachably attached together by loop pile or Velcro fastener means.

1 Claim, 7 Drawing Figures

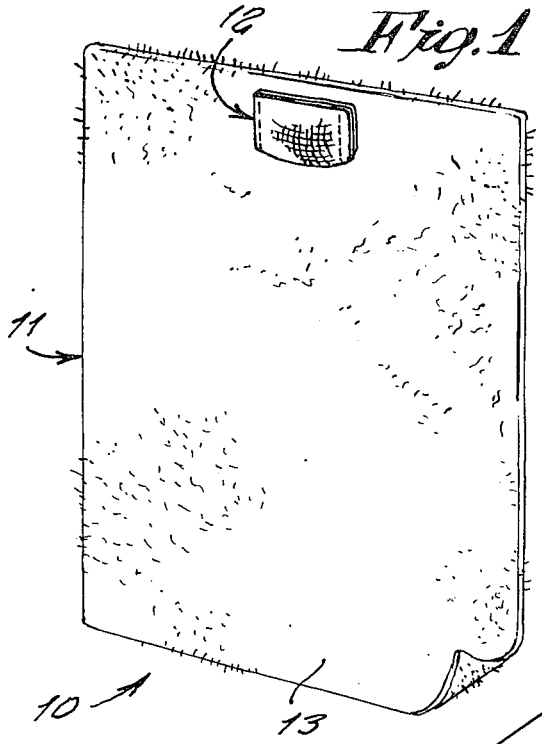
Fig. 1
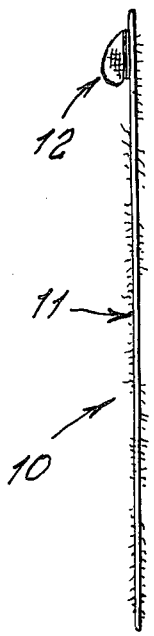
Fig. 2
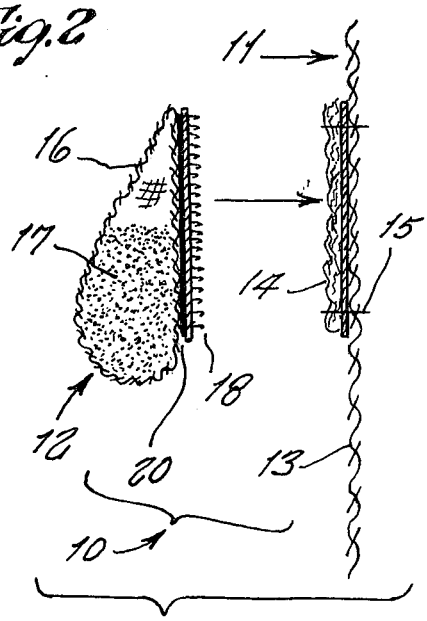
Fig. 4
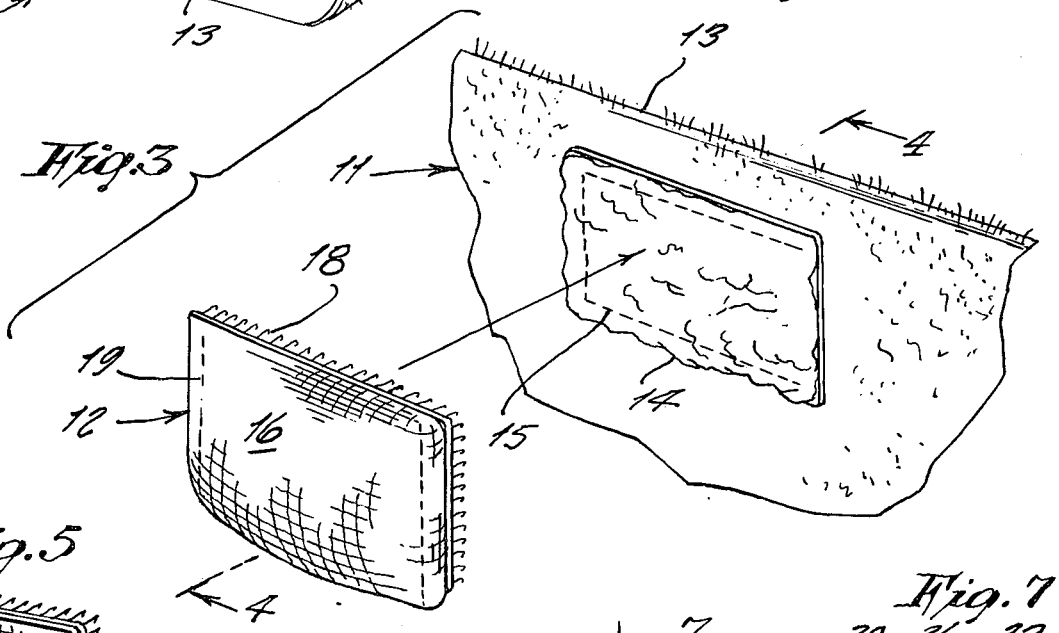
Fig. 3
Fig. 5
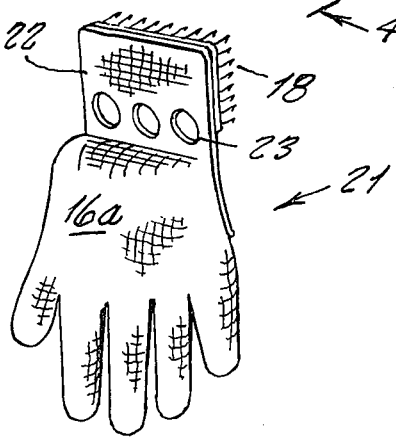
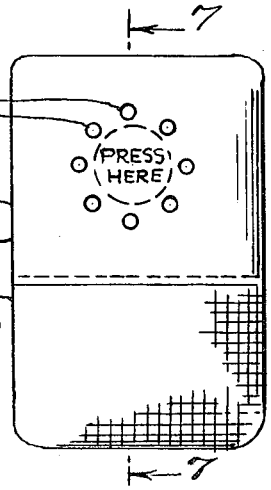
Fig. 6
Fig. 7
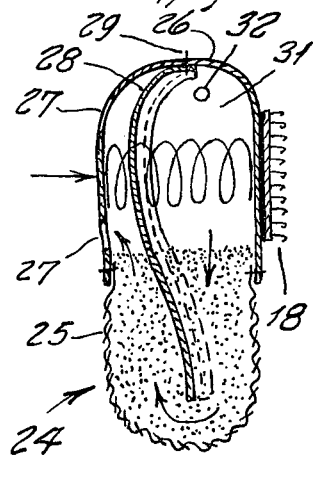

ROSIN BAG AND TOWEL ATTACHED TOGETHER

This invention relates generally to sporting accessories. More specifically, it relates to hand towels for use by athletes or players in various physically active sports.

It is generally well known by all persons who participate in various physical sports that often a player's hands get too moist or wet from perspiration, in order to play in top form, if he is obliged to grasp any object firmly in his hands, such as, for example: by baseball pitchers and batters, basketball players, tennis players, football players, bowlers, and the like. The can be particularly significant in competitive games, in which every small detail becomes important, in order to beat a formidable challenger. Thus, such players are often seen, during a pause in the game, first to rub their hands on a bag of powdered rosin, so that the rosin powder gives a slip-proof frictional grip to the hand. After rosining, the player then wipes the hand in a towel, so as to remove any excess rosin powder from the hand. Sometimes, the towel is not located anywhere near the rosin bag, so that the player may have to hunt for one or the other. This can be an annoying inconvenience to a player, when he is trying to concentrate his mind on the game, instead.

Therefore, it is a principal object of the present invention, to provide a rosin bag and a towel which are attached together, so as to have both handy, in view of the fact that both are needed when rosining up the hands.

Another object is to provide a rosin bag and towel attached together, which, in addition to being useful in sports, would be useful to various industrial workers who are obliged to hold a tool in their hands, while the hands are sweating profusely.

Other objects are to provide a rosin bag and towel attached together, which is simple in design, inexpensive to manufacture, rugged in construction, easy to use, and efficient in operation.

These, and other objects, will be readily evident, upon a study of the following specification, and the accompanying drawing, wherein:

FIG. 1 is a side perspective view of the assembled invention;

FIG. 2 is an end edge view thereof;

FIG. 3 is an enlarged perspective detail view of the bag unit and towel unit, shown detached;

FIG. 4 is a side cross-sectional view, taken on line 4—4 of FIG. 3;

FIG. 5 is a perspective view of another design of bag unit which is in the shape of a hand, so that a person can shake hands with it, so as to get rosin on his own hand;

FIG. 6 is a front view of yet another design of bag unit, which includes a lower bag portion for being kneaded inside a hand, so that rosin powder squeezes out through the bag cloth, or else an upper portion of the bag may be pushed at its center by a finger, so that rosin powder is blown outward through the small holes, and FIG. 7 is a side cross-sectional view, taken on line 7—7 of FIG. 6.

Referring now to the drawing in greater detail, and more particularly to FIGS. 1 to 4, at this time, the reference numeral 10 represents an assembly, according to the present invention, wherein there is a towel unit 11 and a rosin bag unit 12, which are detachably attachable together. The towel unit comprises a towel 13 made of terry cloth, and which has a rectangular piece of Velcro or loop pile fastener member 14 secured near one end thereof, by means of boxstiches 15, the member 14 comprising a fluffy pad of matted fibers or pile. The rosin bag unit comprises a bag 16, containing powdered rosin 17, the bag being made of a loose weave fabric, so that the rosin powder can be shaken therethrough, out of the bag. A rectangular piece of Velcro or loop pile fastener member 18 is permanently adhered to one side of the bag, by means of reinforced stitches 19 and contact cement 20; the member 18 comprising a mat of hooks, for being detachably attachable to the member 14.

It is now apparent that, in use, at a sport event, the towel unit and rosin bag unit are attached, so as to be handily together, when needed by a player. However, when the towel needs to be laundered, the rosin bag unit is detached therefrom. Also, when all the rosin is used up, the empty bag unit can be detached, discarded, and replaced by a new bag unit that is full of rosin powder.

In use, the player simply kneads the rosin bag in his hand, so that it becomes coated with the rosin powder. Then he wipes his hand on the towel.

While the present invention is not limited to any specific size, it can be made for most practical purposes, having a towel measuring sixteen and one half by twenty two inches, and the rosin bag being three and one half by two and one quarter inches.

In a modified design 21 of the invention, shown in FIG. 5, the rosin bag **16*a* is in the shape of a glove with fingers, so that, in use, the player merely shakes hands with it, for obtaining the rosin powder. The bag 16*a* depends from a length of fabric strip 22, which, at its end, is attached to the Velcro member 18. A row of holes 23** thereacross makes it more flexible in use.

Referring now to FIGS. 6 and 7, another modified design 24 of the invention has a rosin bag **16*b*, which includes a lower portion 25 made of the above-described, loose woven fabric, stitched to an upper portion 26 made of non-porous, flexible plastic sheeting. The upper portion has large holes 27, only on its front side. A flap 28, of similar non-porous plastic, depends in the bag from the top and side stitching 29, and down into the rosin powder hanging in a lower end of the bag. A compression coil spring, threaded through the flap, is held between front and rear walls of the bag, so as normally to maintain an air chamber 31, which fills with air filtered thereinto through a small bleed hole 32. The bag is attached to the above-described Velcro member 18**.

In use, the bag may be used as described above, by kneading the lower portion of the bag in a hand, or else, if more powder is wanted, then the front wall of the bag is pushed against the spring, causing the air in the chamber 31 to be pushed down through the powder, around a bottom edge of the flap, up in front of the flap, and then out of the holes 27, thus blowing the powder at the person's hand.

While various changes may be made in the detail construction, it is understood that such changes will be within the spirit and scope of the present invention, as is defined by the appended claims.

What I claim as new, is:

1. An article of manufacture for rosining and wiping the hands of an athlete, comprising, in combination, a towel unit and a bag unit, detachably attached together by loop pile fastener means, said towel unit including a towel of terry, and said bag unit including a bag containing rosin powder; said bag also including means for being kneaded selectively in a hand or being pushed for blowing a quantity of said rosin powder at said hand; said means comprising said bag, being made of an upper portion of non-porous flexible plastic sheeting material stitched to a lower portion of loose woven fabric, a plurality of large holes through the front side of said upper portion, a flap inside said bag being threaded on a horizontal compression coil spring between the rear side of said upper portion and said upper portion front side, and said flap forming a rear chamber and a front chamber inside said bag which communicate with each other beneath a lower edge of said flap.

* * * * *